US010766512B2

(12) United States Patent
Garmson

(10) Patent No.: US 10,766,512 B2
(45) **Date of Patent: *Sep. 8, 2020**

(54) WIRELESS TRAIN MANAGEMENT SYSTEM

(71) Applicant: Arup Ventures Limited, London (GB)

(72) Inventor: Kenneth Garmson, Warren, NJ (US)

(73) Assignee: Arup Ventures Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/703,350

(22) Filed: Dec. 4, 2019

(65) Prior Publication Data

US 2020/0108848 A1 Apr. 9, 2020

Related U.S. Application Data

(63) Continuation-in-part of application No. 15/992,883, filed on May 30, 2018, now Pat. No. 10,518,790, which is a continuation of application No. 15/878,157, filed on Jan. 23, 2018, now abandoned.

(51) Int. Cl.

| | |
|---|---|
| ***B61L 15/00*** | (2006.01) |
| ***B61L 25/02*** | (2006.01) |
| ***B61L 25/04*** | (2006.01) |
| ***B61L 27/00*** | (2006.01) |
| ***B61L 3/00*** | (2006.01) |
| ***B61L 23/08*** | (2006.01) |
| ***B61L 3/12*** | (2006.01) |

(52) U.S. Cl.

CPC ..... *B61L 15/0027* (2013.01); *B61L 3/006* (2013.01); *B61L 3/008* (2013.01); *B61L 3/125* (2013.01); *B61L 15/0072* (2013.01); *B61L 23/08* (2013.01); *B61L 25/023* (2013.01); *B61L 25/025* (2013.01); *B61L 25/04* (2013.01); *B61L 25/045* (2013.01); *B61L 25/048* (2013.01); *B61L 27/0005* (2013.01); *B61L 27/0066* (2013.01); *B61L 27/0077* (2013.01); *B61L 2027/005* (2013.01)

(58) Field of Classification Search

None

See application file for complete search history.

(56) References Cited

U.S. PATENT DOCUMENTS

| | | | |
|---|---|---|---|
| 8,428,798 | B2 | 4/2013 | Kull |
| 9,669,850 | B2 | 6/2017 | Fuchs et al. |
| 9,711,046 | B2 | 7/2017 | Shubs, Jr. |
| 10,518,790 | B2 | 12/2019 | Garmson |
| 2008/0068164 | A1 | 3/2008 | Campbell |

(Continued)

FOREIGN PATENT DOCUMENTS

| | | |
|---|---|---|
| CN | 109178039 A | 1/2019 |
| CN | 109305196 B | 2/2019 |

*Primary Examiner* — Thomas G Black
*Assistant Examiner* — Demetra R Smith-Stewart
(74) *Attorney, Agent, or Firm* — David Postolski, Esq.

(57) ABSTRACT

A train control system comprising a track switch controller; RFID tags located at first and second track switches coupled via a length of track that store characteristics of train sets as they pass the track switches, and RFID tag readers located on the train sets, connected to a network. The train sets write data to the RFID tags such that the data is read by RFID tag readers of subsequent trains; and the data stored in the RFID tags is overwritten with new data each time a train set passes by the RFID tags.

19 Claims, 17 Drawing Sheets

(56) References Cited

U.S. PATENT DOCUMENTS

| | | | | |
|---|---|---|---|---|
| 2010/0032529 | A1* | 2/2010 | Kiss | B61L 17/02 246/122 R |
| 2014/0263862 | A1* | 9/2014 | Morris | B61L 27/0077 246/2 R |
| 2015/0060608 | A1* | 3/2015 | Carlson | B60T 8/1705 246/122 R |
| 2015/0302752 | A1* | 10/2015 | Holihan | G08G 1/164 246/62 |
| 2017/0043797 | A1 | 2/2017 | Allshouse et al. | |
| 2017/0217462 | A1* | 8/2017 | West | B61L 27/0077 |
| 2017/0349195 | A1* | 12/2017 | Benedict | B65G 63/008 |

* cited by examiner

WIRELESS TRAIN MANAGEMENT SYSTEM

CLAIM OF PRIORITY

This application is a CIP of U.S. patent application Ser. No. 15/992,883 filed May 30, 2018, which is a Continuation of non-provisional U.S. patent application Ser. No. 15/878,157 filed Jan. 23, 2018, the contents of which are incorporated herein by reference in their entirety.

FIELD OF THE INVENTION

The field of the present invention and its embodiments relate to a system and method of managing train positions, distances, speeds, and locations within a train system.

BACKGROUND

Communication Based Train Control (CBTCs) systems have been evolving throughout the years, implementing new versions of technology as they are released and although the CBTC components upgrade overtime, the core system architecture still remains the same as it's fruition in the late 1980's.

Advances in data storage and processing now enable far greater digital applications to occur in much smaller footprint and at a fraction of the cost. Along with hardware advances and widespread availability, the adjoining software development has become a much more common skill and is approaching the same commonality as reading and writing skills. With these technological and social advances, an opportunity is presented to redefine the typical CBTC system architecture to elevate train control solutions and make the system relatable to today's world. Train Control processing now has the ability to move from a large centralized control facility into each train, creating autonomy on the rail, presenting tremendous opportunity for optimization in functionality, operation, maintenance, installation, cost, and so much more.

With many of the industrialized nations and cities around the world having to come to grips with their aging public transportations systems a need and an opportunity arose for a modern approach to overseeing these systems. In recent years, multiple disclosures have attempted to fix various aspects of existing systems. Various systems and methodologies are known in the art. However, their structure and means of operation are substantially different from the present disclosure.

Review of Related Technology:

U.S. Pat. No. 9,669,850 pertains to a method and system for monitoring rail operations and transport of commodities via rail, a monitoring device including a radio receiver is positioned to monitor a rail line and/or trains of interest. The monitoring device including a radio receiver (or LIDAR) configured to receive radio signals from trains, tracks, or trackside locations in range of the monitoring device. The monitoring device receives radio signals, which are demodulated into a data stream. However, this disclosure requires memory storage of the trains' activities at a central location instead of on the RFID tags.

U.S. Pub. 2017/0043797 pertains to Methods and systems that utilize radio frequency identification (RFID) tags mounted at trackside points of interest (POI) together with an RFID tag reader mounted on an end of train (EOT) car. The RFID tag reader and the RFID tags work together to provide information that can be used in a number of ways including, but not limited to, determining train integrity, determining a geographical location of the EOT car, and determine that the EOT car has cleared the trackside POI along the track. This publication discloses storing memory on the RFID tags but does not disclose having the memory be volatile.

U.S. Pat. No. 9,711,046 pertains to a control system presenting a configurable virtual representation of at least a portion of a train and associated train assets, including a real-time location, configuration, and operational status of the train and associated train assets traveling along a railway. The control system may include a train position determining system, (such as RFID) and a train configuration determining system.

The train control system disclosed herein establishes a virtual train-to-train communication path, coupled with the on-board processing enabling the trains to operate autonomously and in complete synchronization with all other trains on the line, reducing communication overheads and processing delays inherent in traditional CBTC systems. The open source of software and hardware enable existing train systems to have multiple vendors for the supply chain thereby promoting competitive pricing, and installation flexibility.

SUMMARY OF THE EMBODIMENTS

A train control system comprising a track switch controller; RFID tags located at first and second track switches coupled via a length of track that store characteristics of train sets as they pass the track switches, and RFID tag readers located on the train sets, connected to a network. The train sets write data to the RFID tags such that the data is read by RFID tag readers of subsequent trains; and the data stored in the RFID tags is overwritten with new data each time a train set passes by the RFID tags.

It is to be understood that both the foregoing general description and the following detailed description are exemplary and explanatory and are intended to provide explanation of the invention as claimed.

DETAILED DESCRIPTION

Figure 1:
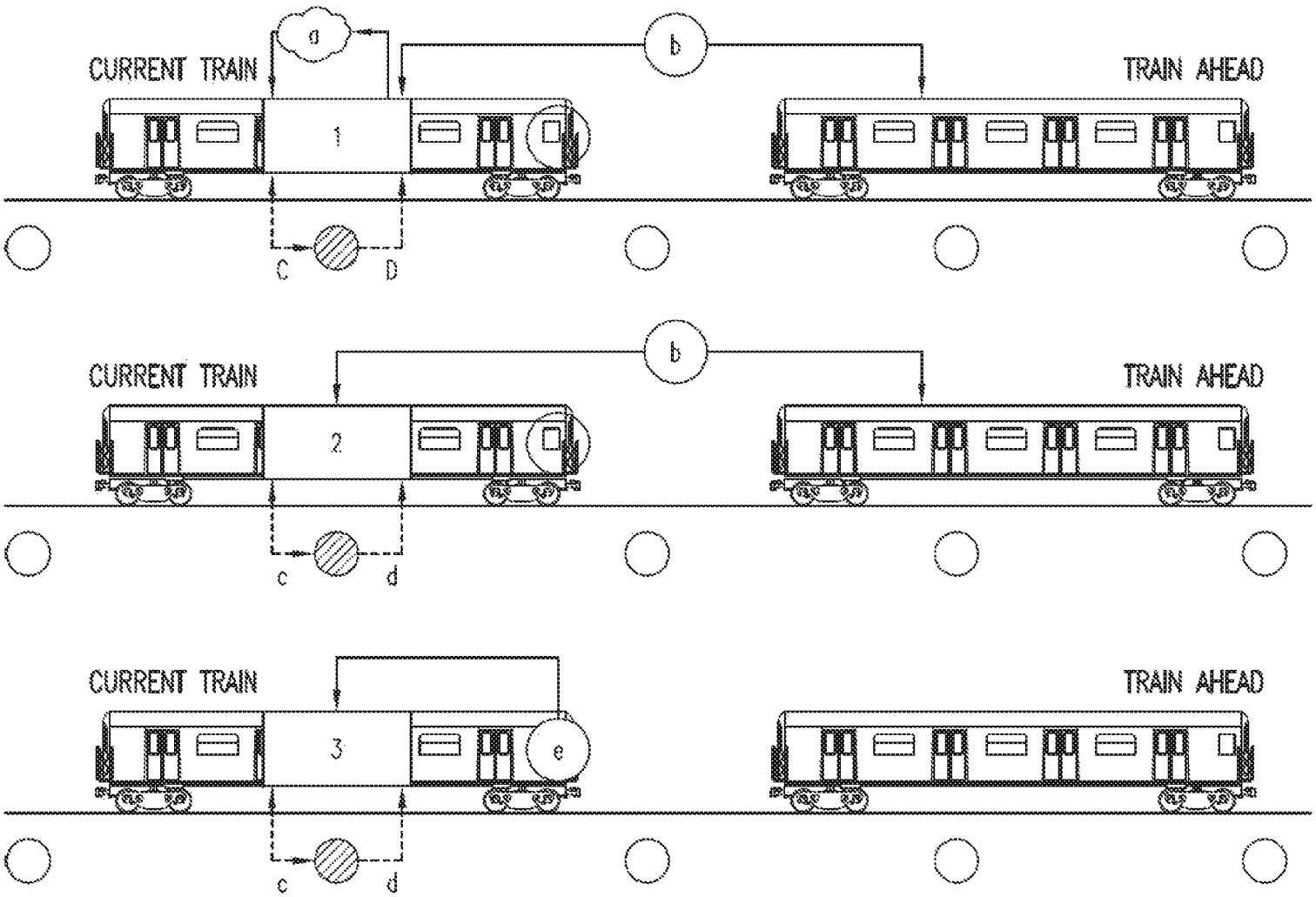
FIG. 1 shows the three modes of operation of system.

Embodiments of the present invention will now be described with reference to the drawings, in which identical elements in the various figures are identified with the same reference numerals. These embodiments are provided by way of explanation of the present invention, which is not intended to be limited thereto. Those of ordinary skill in the art may appreciate upon reading the present specification and viewing the present drawings that various modifications and variations can be made thereto.

The present invention, sometimes hereinafter referred to as the 'Acorn' system, is designed to allow train sets to operate along a railway autonomously while reducing trackside infrastructure to a minimum. Acorn is based upon the principles and standards noted in IEEE 1474.1: "IEEE Standard for Communications-Based Train Control (CBTC) Performance and Functional Requirements", but, unlike traditional systems using trackside equipment, the equipment located on the train is used to control the movement of trains. At the center of the Acorn design is the placement of Acorn Tags at an interval typically 10-30 feet but preferably at 25 feet along the track. Along straight (or through) track areas, Type 1 Acorn Tags are placed at the typical interval with no hardwire connections. At switch and crossing locations, Type 2 Acorn Tags are deployed at the typical interval with series hardwired connections simulating track circuits. These simulated track circuits can interface with the interlocking controller and communicate with approaching trains, allowing the system to operate seamlessly.

Below, in systems operating at 90 mph, only one Acorn tag and reader interface method is required to achieve a successful read write cycle, simplifying the installation. However, if a deployment needs to support speeds greater than 90 mph, the system can be configured, as is, to leverage a split read write cycle to continue achieving a successful read write cycle.

The Acorn System is an open protocol based system, allowing software applications to be available from multiple vendors and sources and the system being adaptable to various systems around the world, using multiple operating systems on different platforms. This approach, as with the supply of the Acorn Tags, does not lock the Acorn system into a single supplier of the system. Furthermore, this approach removes common failure modes in both software and hardware of the system.

Referring now to FIG. 1, a method for controlling a train system is illustratively depicted, in accordance with an embodiment of the present invention. According to an embodiment, a first train car of a first train set communicates to a first train car of second train set via a centralized data network using radio controlled communication (RCC), wherein the RCC includes a track database, a schedule database, and a route database, with the first train car of the first train set communicating to the first train car of the second train set via a back-up communication system.

According to an embodiment, the system architecture used in the present method enables several layers of communication to transmit and receive the critical data on-board to calculate safe headway. These layers of communication help form the three modes of operation (labelled at 1, 2, and 3 in FIG. 1) to ensure the continuous safe operation of trains. Mode 1 uses all layers of technology to provide the systems minimum headway, leading Mode 1 to be the primary and thus normal mode of operation. According to an embodiment, in Mode 1, normal operation calculates headway with the following redundant inputs: RCC broadcasted Schedule Updates and Train Location confirmations (a); Train to Train broadcasted Train Location confirmations (b); Tag read Train Ahead Time and Speed (c); Tag read Current Train Location confirmation (d); and LIDAR enabled Rail Visual Range sensing clear distance ahead (e).

According to an embodiment, the subsequent mode of operation, Mode 2, is reduced and engages when RCC communication is lost, but allows the system to continue functioning by increasing the minimum headway. Lastly, Mode 3 shows autonomous operation that enables total train autonomy by relying on tags and on-board equipment information only, imposing the most restrictive headway.

According to an embodiment, the backup communication system includes at least a first set of two trackside points located along a path of the first train set and at least one RFID Type 1 tag located at each of the at least two trackside points configured to store characteristics of the first train set as it passes the first set at least two track side points and at least a second set of two trackside points located along at a track switch with at least one RFID Type 2 tag being located at each of the at least two trackside points configured to store characteristics of the train set as it passes the second set of the at least two track points and at least one RFID tag reader being located on the first train set and at least one RFID tag reader located on the second train set.

The RFID type 1 tag or the RFID type 2 tag of the back-up system can store a speed, a brake status, a train ID, a switch status, a time stamp, and a schedule of the latest train to pass the RFID type 1 tag or the RFID type 2 tag. The speed, the brake status, the train ID, the switch status, the time stamp, and the schedule of the latest train to pass the RFID type 1 tag or the RFID type 2 tag, that are recorded on the tags can be rewritten with information with the next train to pass the RFID type 1 tag or the RFID type 2 tag. The read and write step can be typically completed within between approximately 10 milliseconds and approximately 30 milliseconds, but optimally 20 milliseconds is preferred for safe operation of the system.

Each train can car carry three principle databases onboard, these being the track, schedule and route databases. The track database contains details of the track network and makes use of the Tag unique ID as the key for the entry record of that location. The temporary Speed field being variable and all others fields (civil speed, the next approaching train, the visual range, the next way point) being fixed unless maintenance has changed a tag. The schedule database allows the train to determine its location in relationship with other trains in the system. All fields (Train ID, the planned route, Planned time, and confirmed time) can be preloaded be updated throughout the journey. The route database, can contain the information required to navigate the track system. This database contains information pertaining to the expected location of the individual train in relation to time. The location is determined using unique identifiers (UIDs) assigned to each of a plurality of Tags.

Using the current UID and the Train ID, the Planned Time field can be accessed to determine if the train is ahead or behind of the planned schedule. For operation during Modes 2 and 3, the planned location could be determined using the Train Ahead ID and time. The Acorn System databases can be programmed to have in excess of 100,000 records. On initial startup, a search of all the databases to locate the current Tag UID entry and schedule location may take up to a second to locate the record. Fast indexing may be used thereafter as records will be accessed sequentially, hence incremental increase or decrease.

Train spacing is achieved by establishing the train location from Tags and Inertial navigation system, to an accuracy of at least ±12.5 ft. This data will be stored by the on-board network map and broadcasted to all trains along the route. The on-board network map also updates with train locations that it receives from other train broadcasts. Allowing the car computers to calculate the distance to train ahead, target speed and braking point to maintain a safe operating distance. The Tag has data fields for Time of last train, speed, running status. With no other received data this enables an on board calculation to determine where the train ahead is if it had applied its emergency brakes. As a train updates, it will broadcast its location to all other trains along the line every 100 ft or as determined by the trains operating speed.

To calculate the target speed and available headway for a trainset for use in Modes 2 and 3, the onboard processors can adhere to the following processes:

Headway—the Tag Sequence Array, preloaded from the Track Database, can be used to calculate a distance (in number of tags clear) to train ahead. This value can be known as the Clear Tags value. The tag location of the train ahead can be obtained the following methods: in Mode 1, the Location Database holds the current location of the train ahead. The location can be confirmed via a transmission from the train ahead and a validation has from the Route Control Center. If the location of the Train ahead has been received but not validated by the Route Control Center, then Mode 2 is invoked. Using the preceding train's speed and time when the train was at the tag, the ahead train's location can be predicted assuming a constant speed. This estimated train ahead location is compared to the planned location of that train with the location database and with the reported location from the train. The lower number of the two numbers is used to set the value in the Clear Tags field. If the train has not received any train status updates for more than 500 mS then Mode 3 will be invoked. In Mode 3, the train calculates the number of clear tags ahead from the tag data received and uses the scheduled location to amend the tag clear value as required. The Railway Visual Range will be used to modify the maximum speed permissible. From the obtained Tag Clear value, the train length (converted to number of tags) is subtracted. This becomes the planned stop tag for the train. The number of headway tags is then used to address on-board databases to determine the maximum speed that the train can operate at if it is to stop by the stop tag. The maximum speed derived from the on-board databases will then compared to the Civil Speed, Temporary Speed and choose the lowest value. The data received allows the train to calculate the speed and brake profile of the train ahead.

To determine the speed of the trainset, an Interrupt Request (IRQ) can be used to start a timer sequence that will amount the time between tag reads. The counter will be 64 bit using a 100 μS interval enabling the average speed to be determined using the known tag spacing between tags. At a speed of 10 mph, the counter will reach an integer value of 15,957 between tag readings at the tag spacing, as calculated by the formula below. This counter value could be used to calculate the location of a train between tags, based on the average speed calculated between the previous Tags.

$$(\text{velocity})\left[\frac{\text{ft}}{\text{sec}}\right] = \frac{25(\text{tag distance})[\text{ft}]}{x(\text{integer count}) * 100[\mu\text{S}]} * \frac{1{,}000{,}000}{1[\text{sec}]}$$

$$10\left[\frac{\text{miles}}{\text{hour}}\right] = 15.667\left[\frac{\text{ft}}{\text{sec}}\right] = \frac{25}{1750} * 10{,}000$$

For example, using the equations above, with a trainset traveling at 10 mph, an accurate location and speed calculation occurs every 1,596 mS, thus an accurate location and speed can be broadcasted to the RCC and other trainsets every 1,596 mS. As the speed of the trainset increases, the travel time decreases, allowing for higher broadcast frequency of accurate location and speed values. For example, at an average speed of 25 mph, location updates will occur every 682 mS, and at 60 mph every 284 mS. These update periods are all within IEEE standard values prescribed.

The Wide Area Network (WAN) Communications may use various technologies and networks to provide various levels of connectivity along different types of track areas. Ideally, communications should exist along the entirety of the track system to support broadcasted trainset locations as mentioned above, although continuous WAN communication is not required to continue operations. The broadcasted trainset locations requires only 1024 bits for data transmission and 1024 bits for confirmation acknowledgement, and thus minimal communications is required along the entirety of the track system.

In addition to trainset locations, the WAN Communications will need to support schedule updates from the RCC to each train car. Unlike trainset locations, schedule updates require reasonable bandwidth and will need to be supported by high bandwidth networks. Reasonable locations where high bandwidth communications should exist are stations and switch locations, also known as waypoints.

Within the databases, each record is less than 256 bits and, for a single route, is based on:

12-hour maximum schedule

Inclusion of both Local and Express lines 120-mile total route length 64 trains operation Then the number of records to be updated is approximately 250 kB. Allowing for 16CRC, data verification, and other communication overhead, updating a record of a single train would be 6 Mb, and for a complete schedule update 400 Mb (50 MB). It is noted that various embodiments of the present invention, such as communication and data updating (FIGS. 6A-6B) and data verification (FIGS. 7A-7D) can be presently found in one or more of the present figures (FIGS. 1-7D).

The Acorn System software complexity is significantly less than a typical CBTC system as the need for complex coding has been reduced to simple linear calculations as described in the headway, speed, and location database descriptions above. The individual class structures are defined so that software development of an individual class can be undertaken by different vendors as header file allowing the class to verify independently and not a single source supplier. SIL verification of the code within the header file, if required will be simpler to establish compliance with CENELEC EN 50159 standard, FRA requirements and IEEE standards.

This reduction in coding enables verification to a SIL rating much quicker, as the lines of code are less and multiple vendors can be engaged to provide the code.

At the switch locations, an Acorn Type 2 Tag can be installed for a typical distance of 4,000 feet leading into the actual switch. The Type 2 Tag will allow the interlocking/ARS to communicate with the onboard systems providing status of switch position and target speed for that location. If a dynamic communication between the existing equipment and the Acorn tags is not possible, the interface will provide track circuit emulation using existing trackside signals or in cab signals.

Figure 2:
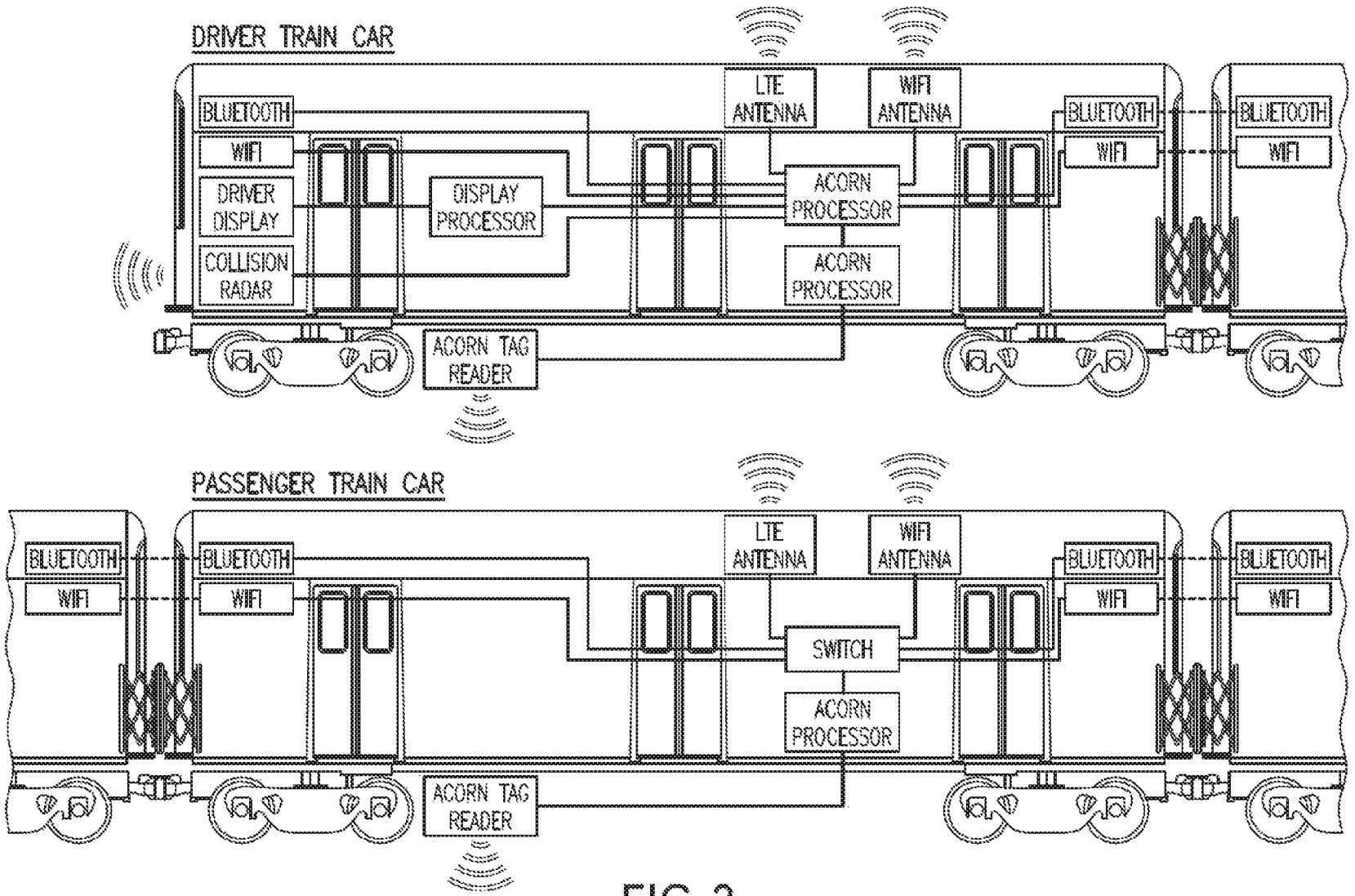
FIG. 2 shows an embodiment of a train set up.

Referring now to FIG. 2, a train control system is illustratively depicted in accordance with an embodiment of the present invention, wherein the system includes a train set having at least one leading car and at least one trailing car, and at least one RFID tag reader located on the at least one leading car and the at least one trailing car connected to a network. According to an embodiment, the RFID tag reader, located on the train (as shown in FIG. 2), can include an RF transparent enclosure containing inside at least a pair of reader antennas wired to a chip reader, connected to the at least one leading car or the at least one trailing car by a wire. According to an embodiment, the network database on the leading car can be connected to the network database on the trailing car by a communication backbone tying together diverse networks, such as Bluetooth and Wi-Fi connections and the network of the leading car and/or the rear car can including a radar.

Figure 4:
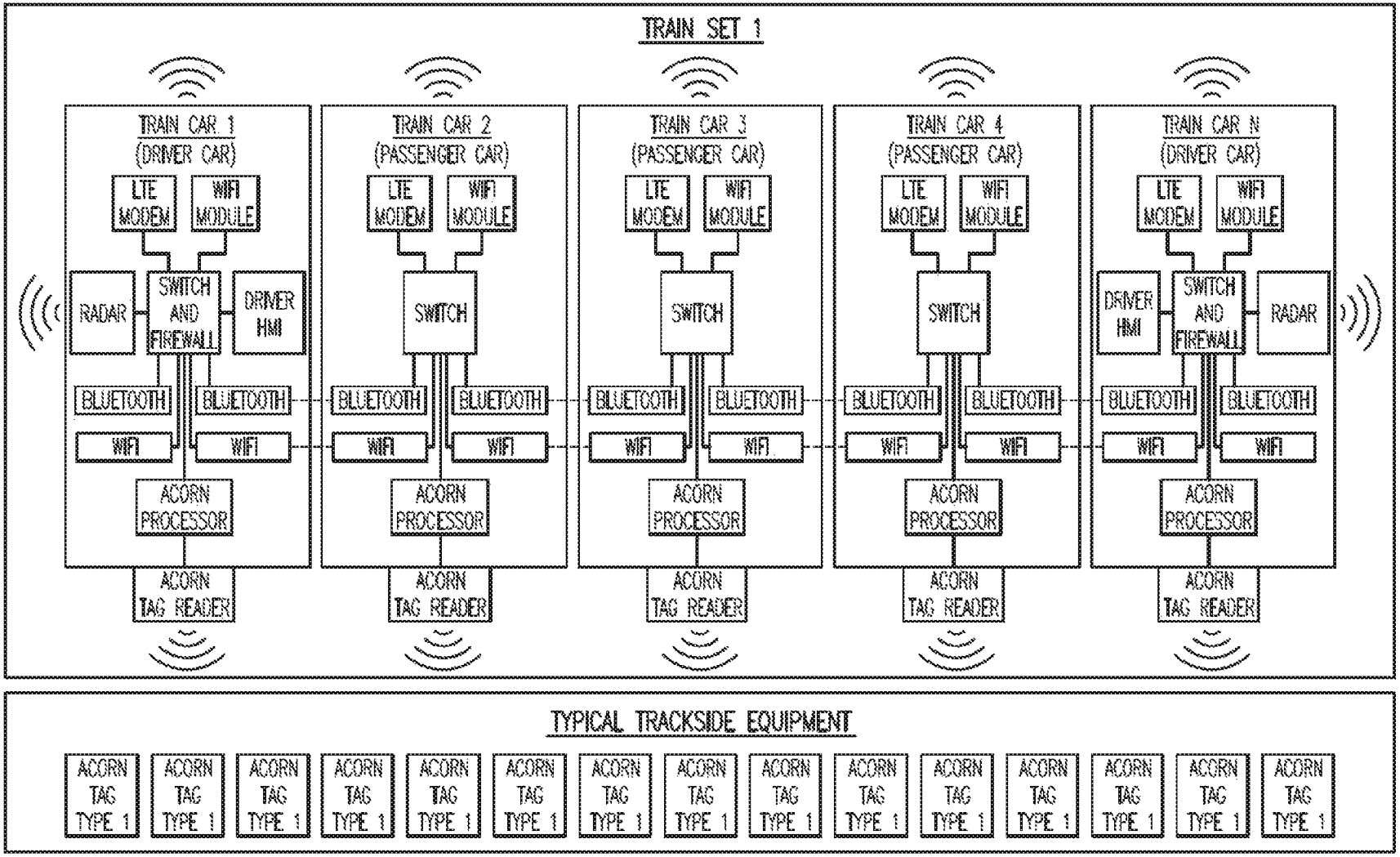
FIG. 4 shows a detail of an operational schematic of an embodiment of the system.
Figure 5A:
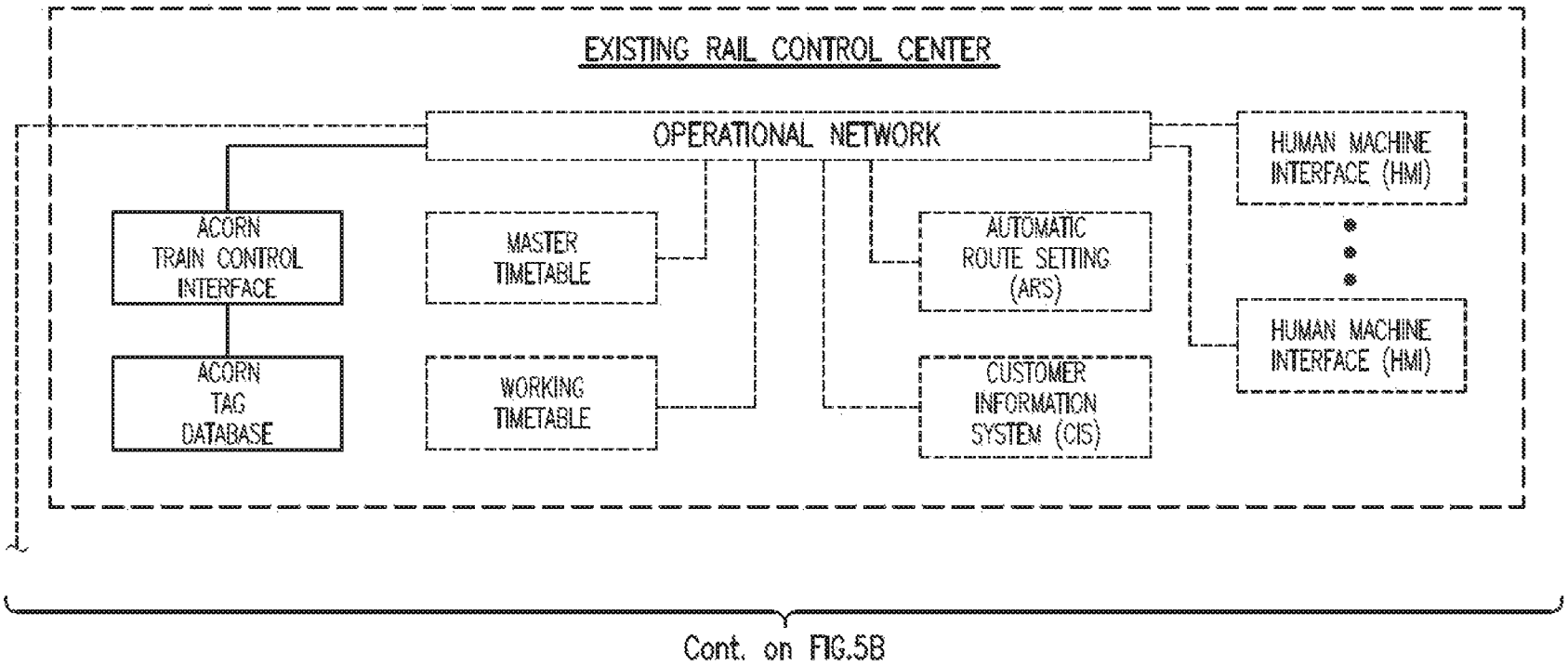
FIG. 5A-5D shows another detail of an operational schematic of an embodiment of the system.
Figure 5B:
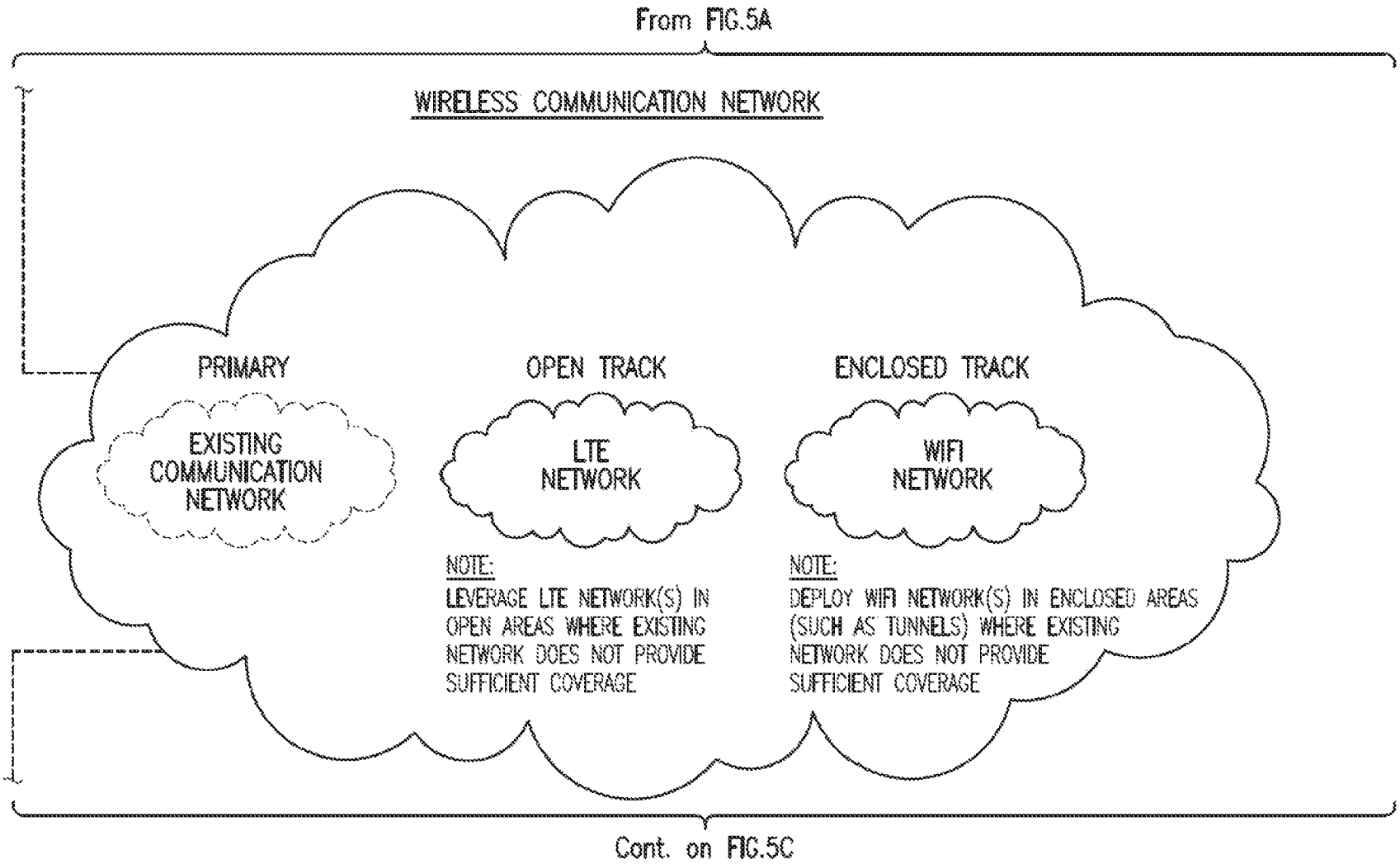
Figure 5C:
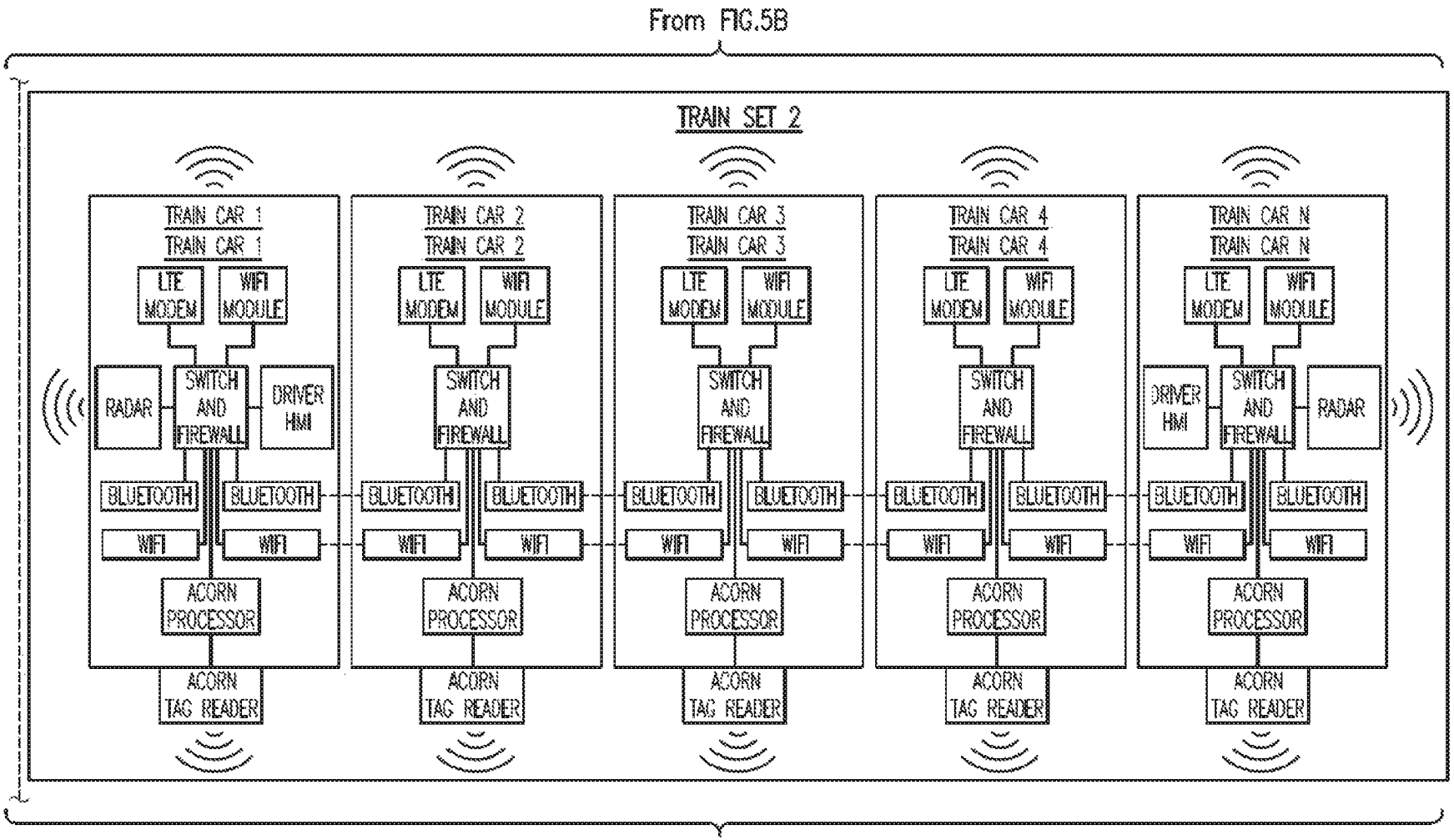
Figure 5D:
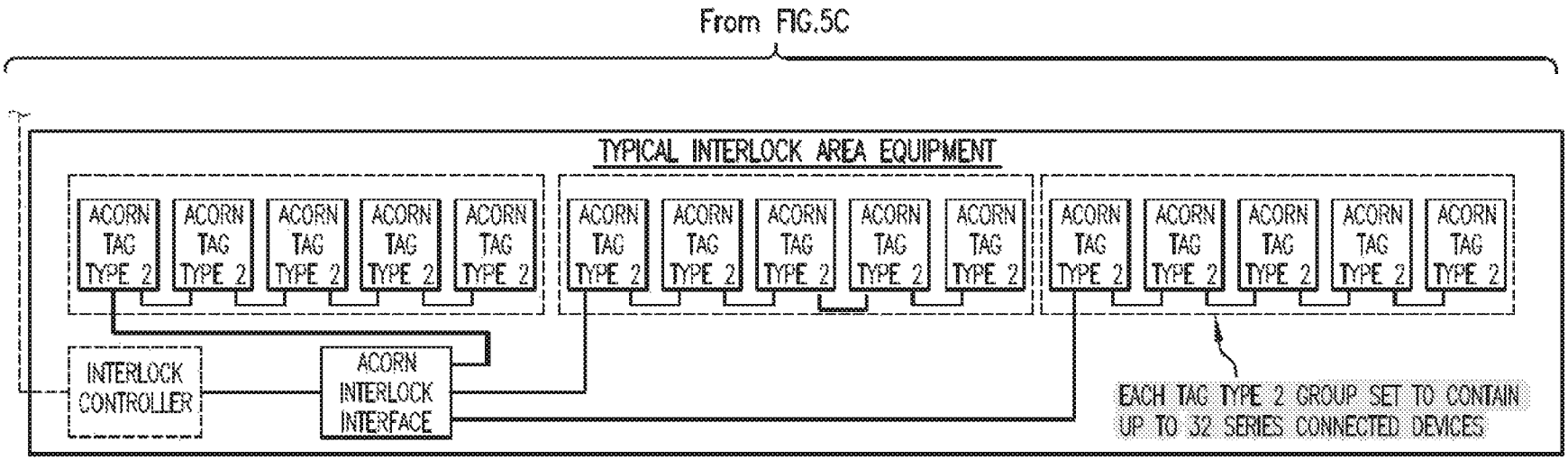
Figure 6A:
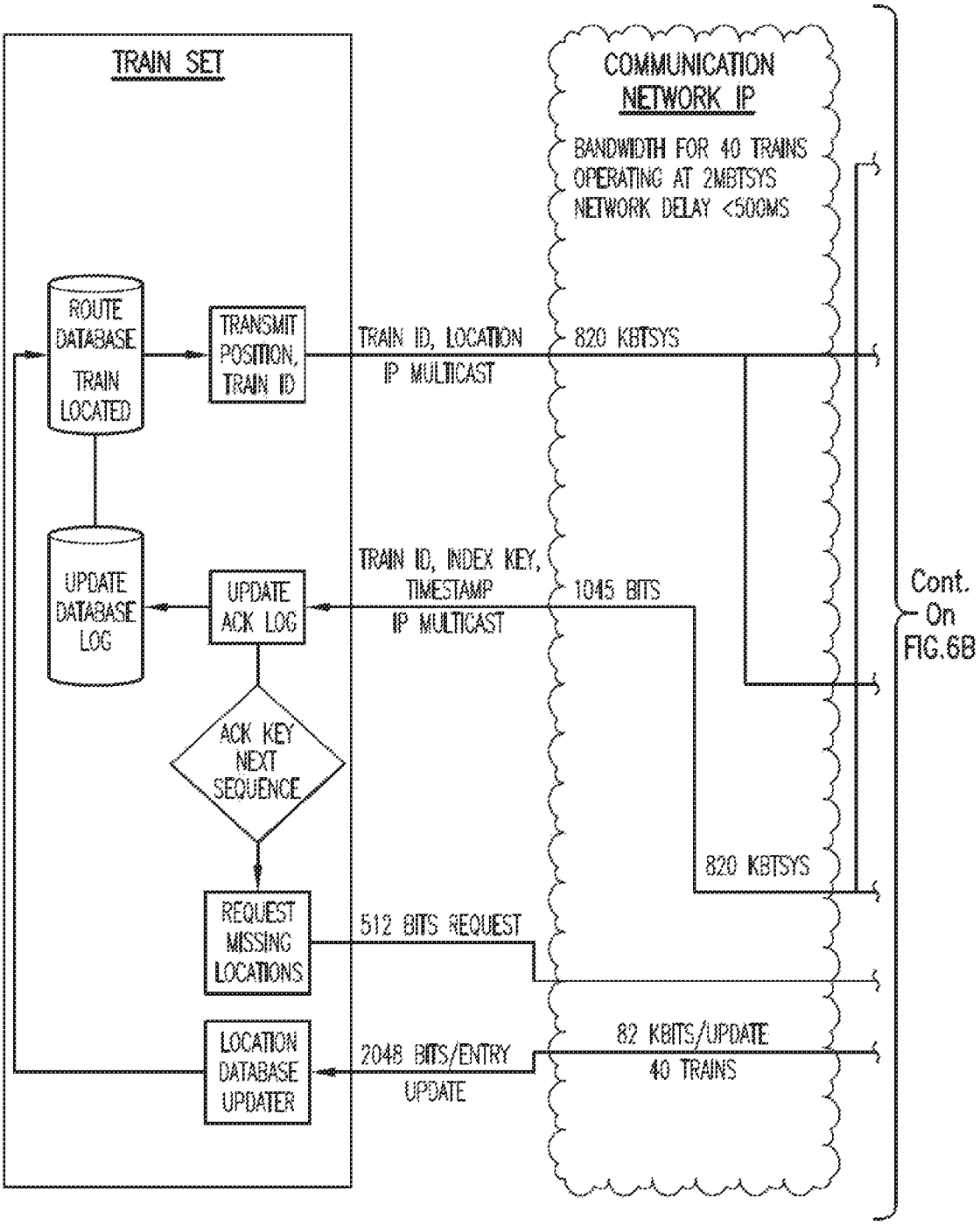
FIG. 6A-6B shows the data flow diagram of an embodiment of the system.
Figure 6B:
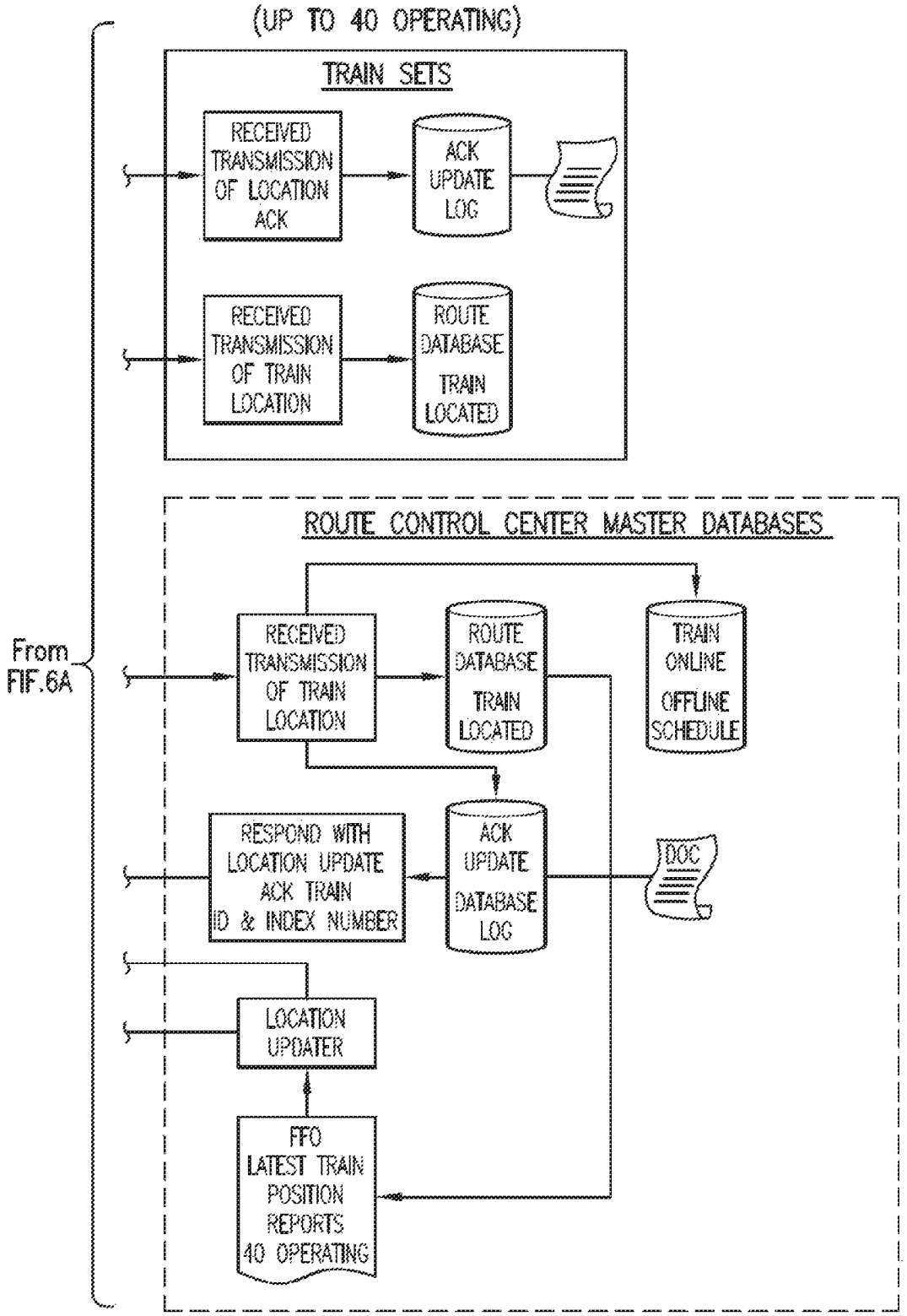
Figure 7A:
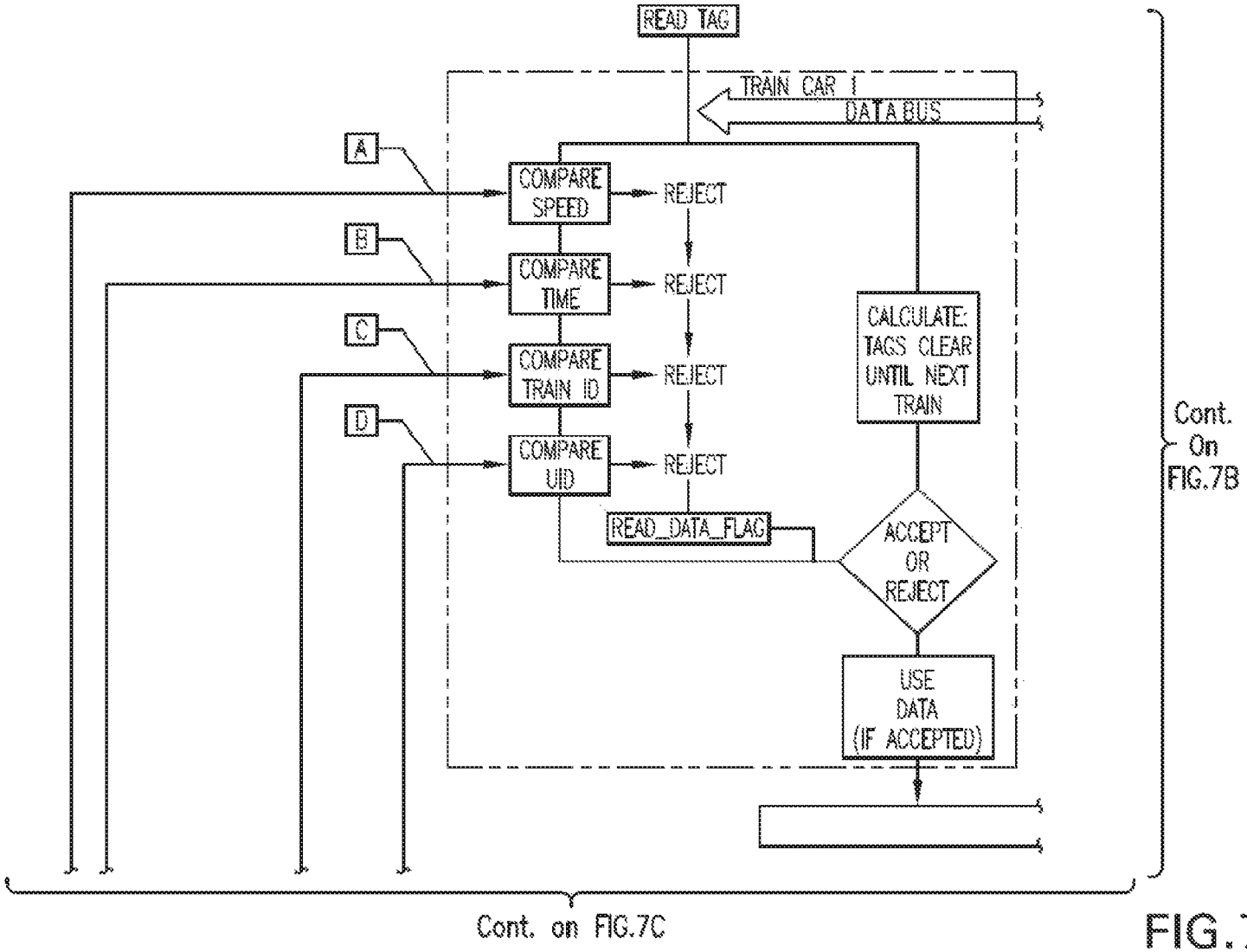
FIG. 7A-7D shows the data verification of an embodiment of the system.
Figure 7B:
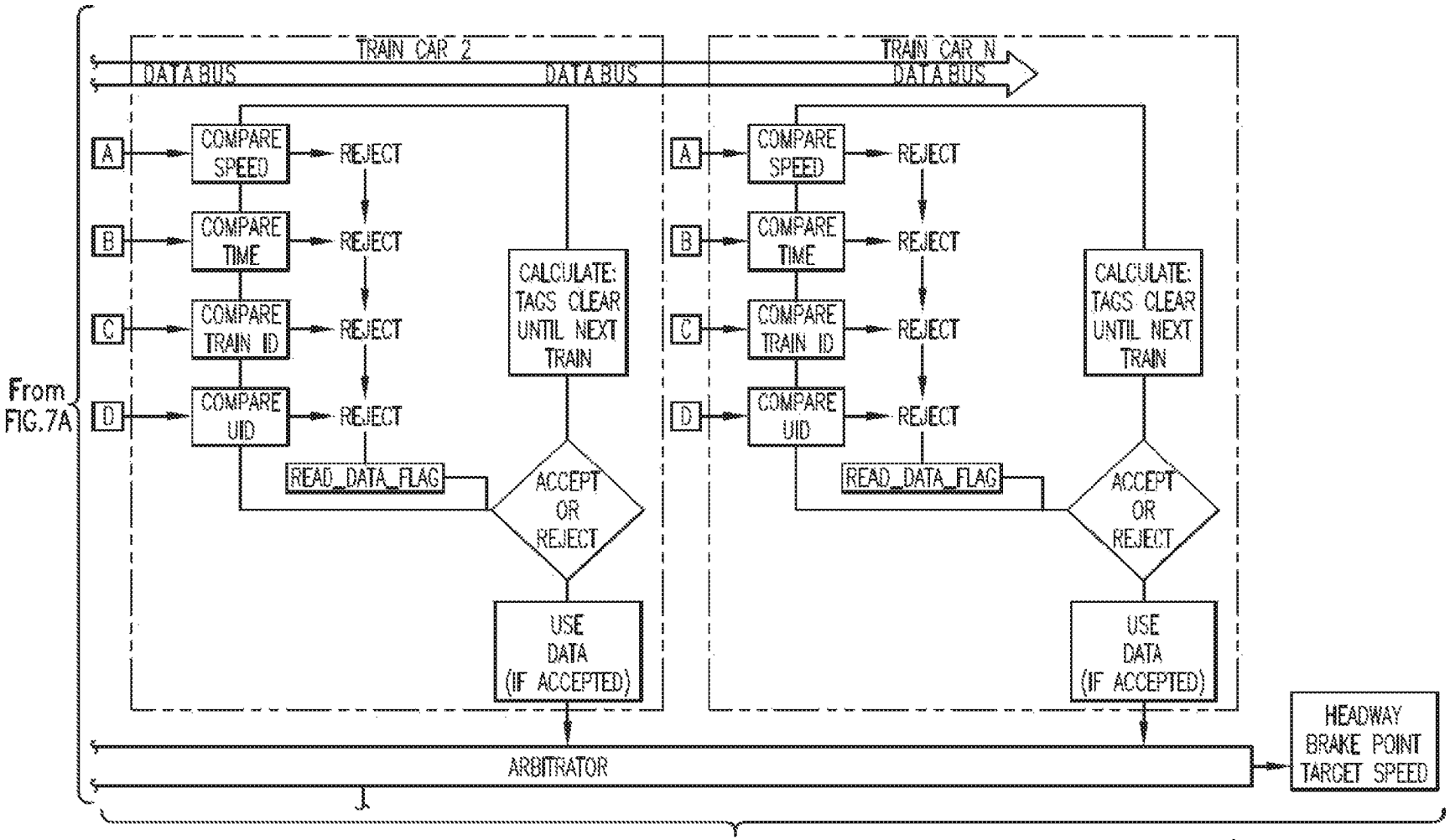
Figure 7C:
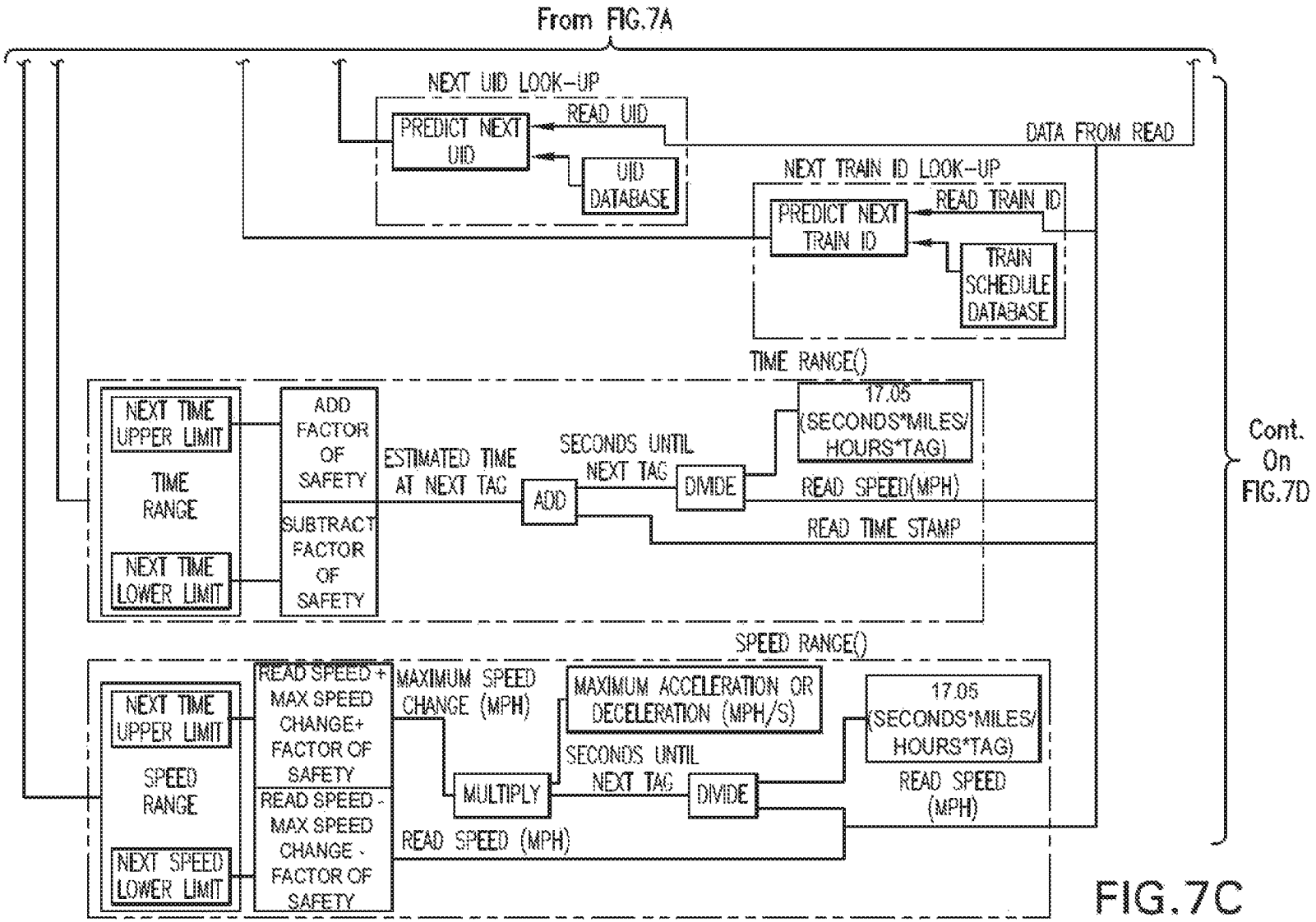
Figure 7D:
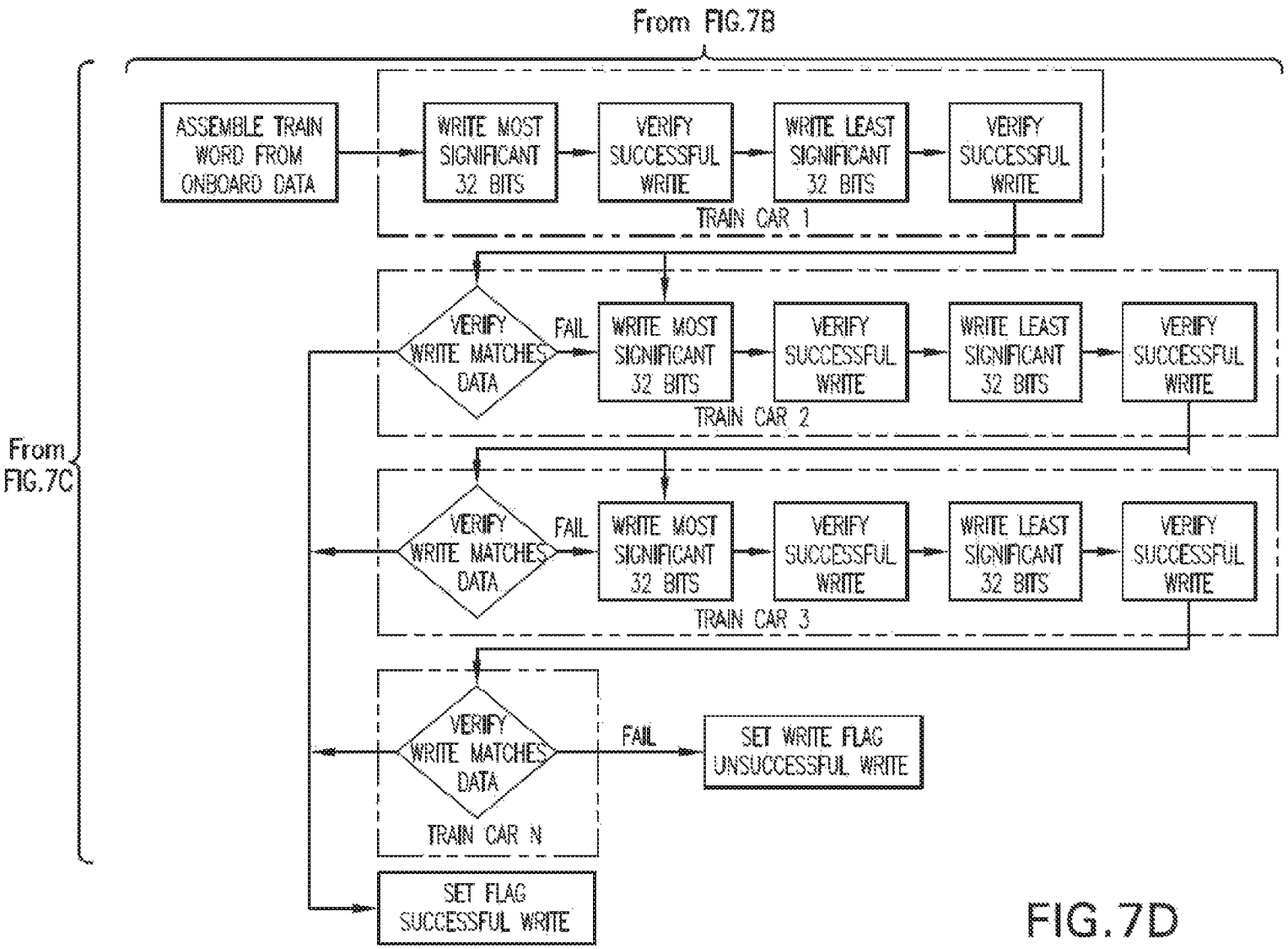

According to an embodiment, the network of the leading car or the trailing car further can be connected to a wireless communication network using an LTE network at locations where the trackside points are at an open track, and a Wi-Fi network at locations where the trackside points are at an enclosed track (as shown in FIG. 4). Alternatively the communication network could use Ultra-Wide Band (UWB) LWIP, LWA, WLAN, ADSL or Cable networks for communications.

Figure 3:
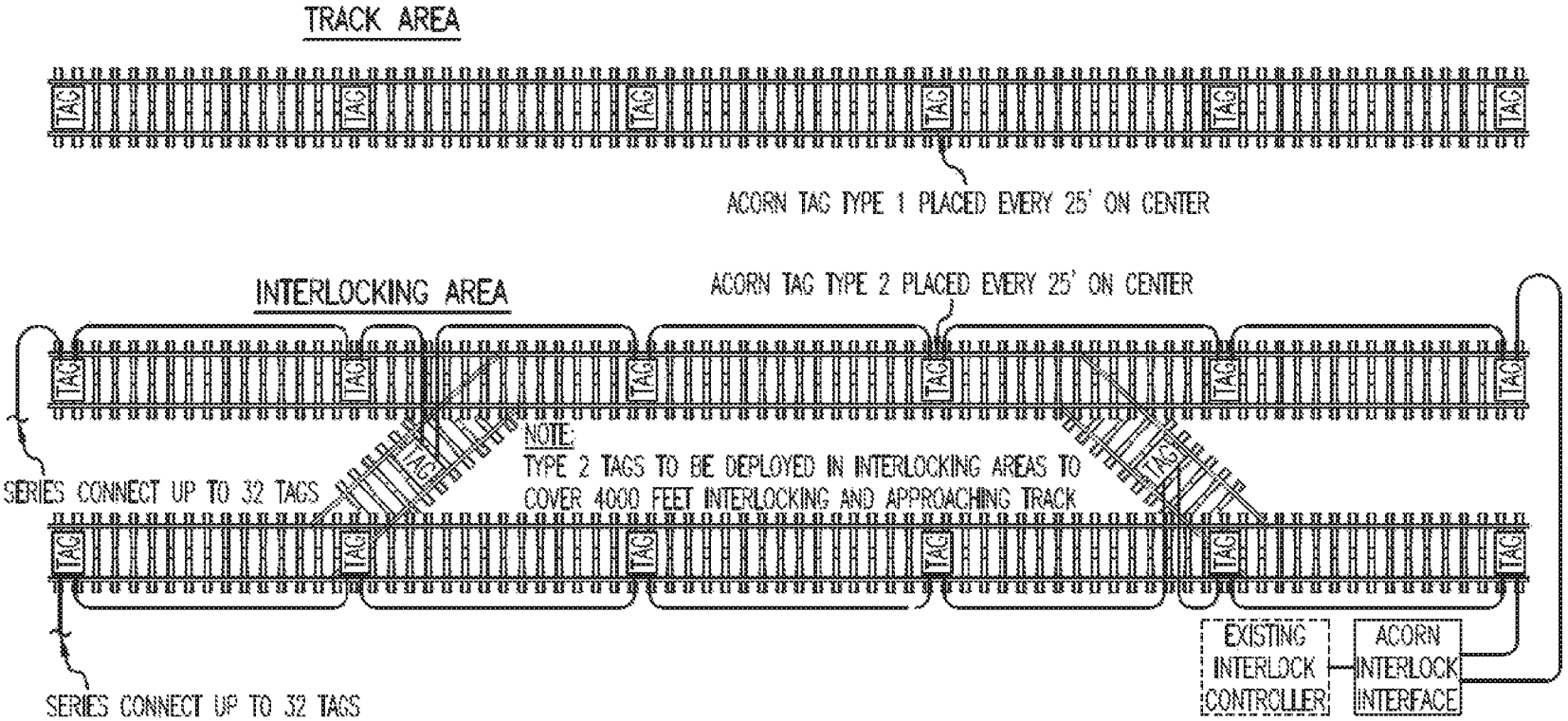
FIG. 3 shows a possible set up of the system along the tracks.

FIG. 3 shows at least a first set of two trackside points located along a path of the train set to which at least one RFID Type 1 tag (Acorn tag) can be connected and configured to store characteristics of the train set as it passes the first set of at least two track side points. FIG. 3 further shows a second set of two trackside points located along a track switch and at least one RFID Type 2 tag (Acorn tag type 2) located at each of the at least two trackside points configured to store characteristics of the train set as it passes the second set of the at least two track points. According to an embodiment, the RFID type 2 tag can be connected to a second RFID type 2 tag by an RS485 cable. The RFID type 2 tag can include an I2C to RS485 converter connected to an RFID chip connected by I2C BUS connection, connected by a parallel connection to a tag antenna. According to an embodiment, the RFID type 1 tag and the RFID tag reader have a separation between approximately 7 inches and 40 inches, with the RFID tag reader can be located on an underside of the leading car and the underside of the trailing car. According to an embodiment, the RFID type 1 tags are spaced apart between approximately 20 to approximately 30 feet from each other, but optimally 25 feet, as seen in FIG. 3.

Referring now to FIG. 4, a detail of an operational schematic is illustratively depicted, in accordance with an embodiment of the present invention.

The interface at the route control center can translate the current train schedule held by the existing system into an Acorn database format adding the additional granularity of target times at each location. As the trains report their locations, the interface will emulate its positional reporting as currently used by the RCC. The second interface to the existing system is the automatic route setting system. If a route has been changed from that planned, the new routes are converted to an Acorn compatible format and transmitted to the Acorn operating trainsets. These interfaces allow operation with existing and enabling mixed traffic operation, which can also be shown in FIGS. 5A-5D.

As shown in FIG. 4, all train cars within the system will include the Acorn Tag Reader mounted to the underside, Wi-Fi and Bluetooth links between cars, Acorn processing equipment inside or outside the cars. WAN antennas on the top of the cars, radar collision detector on the front of driver cars, and a driver display in driver areas.

The key benefit of the Acorn System is that its introduction into service is by an overlay principle and trackside installation being reduce to a minimum avoiding disruption to the users of the systems while minimizing time and cost. To avoid Cyber hacks of the Tags or communications paths encryption is applied to all transmissions and stored Tag data.

According to an embodiment, introduction of service of the Acorn System will occur seamless as the changeover can be practically overnight.

Comparing the industry standard CBTC solutions, the present invention is the only system to utilize RFIDs with the read and write functions for capturing information from the train ahead. No other CBTC system has the "bread crumb" trail, which is a standalone system that can be used to operate trains when all other systems for wireless communications fail. The read/write tags create a virtual block signaling system with the blocks equal to the tag spacing.

In embodiments, a train control system, for use with a train set having at least one leading car and at least one trailing car, comprises a first set of two trackside points located along a path of the train set. At least one RFID Type 1 tag (Acorn tag) is coupled to the two trackside points. The Type 1 tag is configured to store characteristics of the train set as it passes the first set of two track side points. The embodiment further comprises a second set of two trackside points located along a track switch, and at least one RFID Type 2 tag (Acorn tag 2) located at each of the two trackside points. The Type 2 tag is configured to store characteristics of the train set as it passes the second set of track points. The embodiment also comprises at least one RFID tag reader located on the leading car and the trailing car, connected to a network.

In embodiments, a method of controlling a train system comprises a first train car of a first train set communicating with a first car of second train set via a centralized radio controlled communication (RCC) data network, the network containing a track database, a schedule database, and a route database. The first car of the first train set communicates with the first car of the second train set via a back-up communication system, the backup communication system (referred to as mode 1 above) including a first set of two trackside points located along a path of the first train set; an RFID Type 1 tag located at each of the two trackside points configured to store characteristics of the first train set as it passes the first set of two track side points; a second set of two trackside points located along a track switch; an RFID Type 2 tag located at each of the second set of two trackside points configured to store characteristics of the train set as it passes the second set of track points; and at least one RFID tag reader located on each of the first train set and the second train set.

Precise Stopping Point

The wireless train management system described in the foregoing can locate a train set along the track to an interval equal to the tag spacing. However in embodiments, the wireless train management system can be enhanced to enable the system to be stopped with precision at a predetermined point. For example, to interface with objects on a platform when the train stops, such as platform screen doors, or other access points for boarding or loading the train, that require a high degree of accuracy.

In an exemplary embodiment, the tag Reader apparatus of the Wireless Train Management System may include an additional Reader that can acquire the unique identifier (UID) of the tags along the track. The antenna of the Reader may be a directional antenna able to exchange information with a tag when the train is moving below a speed of 30 MPH, and may provide a location reference equal to the width of the antenna. Knowing the direction of travel along a railway track and the location of the Reader, the location of the train doors and car end may be calculated.

Figure 8:
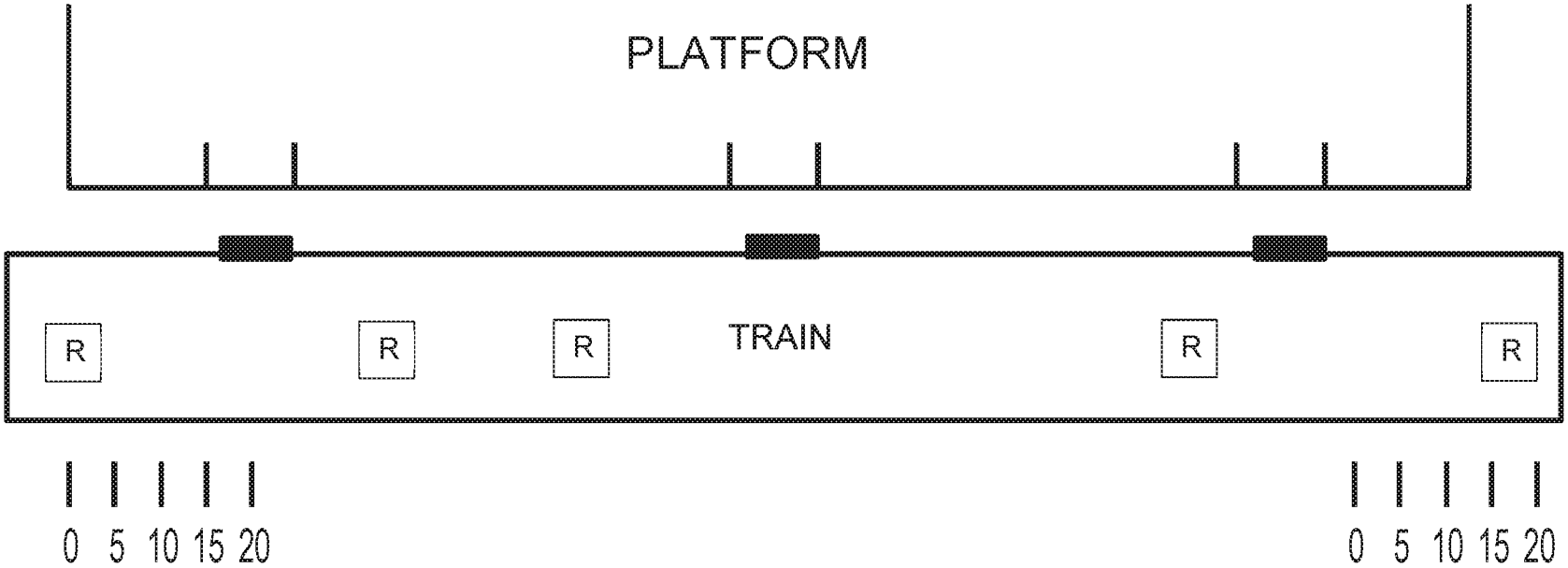
FIG. 8 shows a plan view of a train platform configured to enable a train to stop at a predetermined spot in accordance with an embodiment.

An Exemplary Embodiment is Illustrated in FIG. 8, which Shows a Train Stopped Next to a platform, wherein doors of the train are adjacent to platform entrance points. RFID tag readers on the train are represented by the letter "R" in a block, and the readers read RFID tags placed in sets of 5, with 5 feet between them, although other numbers and spacing of tags may be used. As shown in FIG. 8, to improve the accuracy of stopping the train set at a predetermined point a series of tags may be placed at short regular intervals along the track. For example as shown, the tags may be placed five feet apart, with the last tag in the series indicating the desired stopping point. In an embodiment, the number and/or spacing of tags that form the series may be determined using operating characteristics of the train sets operating along the line.

Storage Yard and Train Set Assembly

Figure 9A:
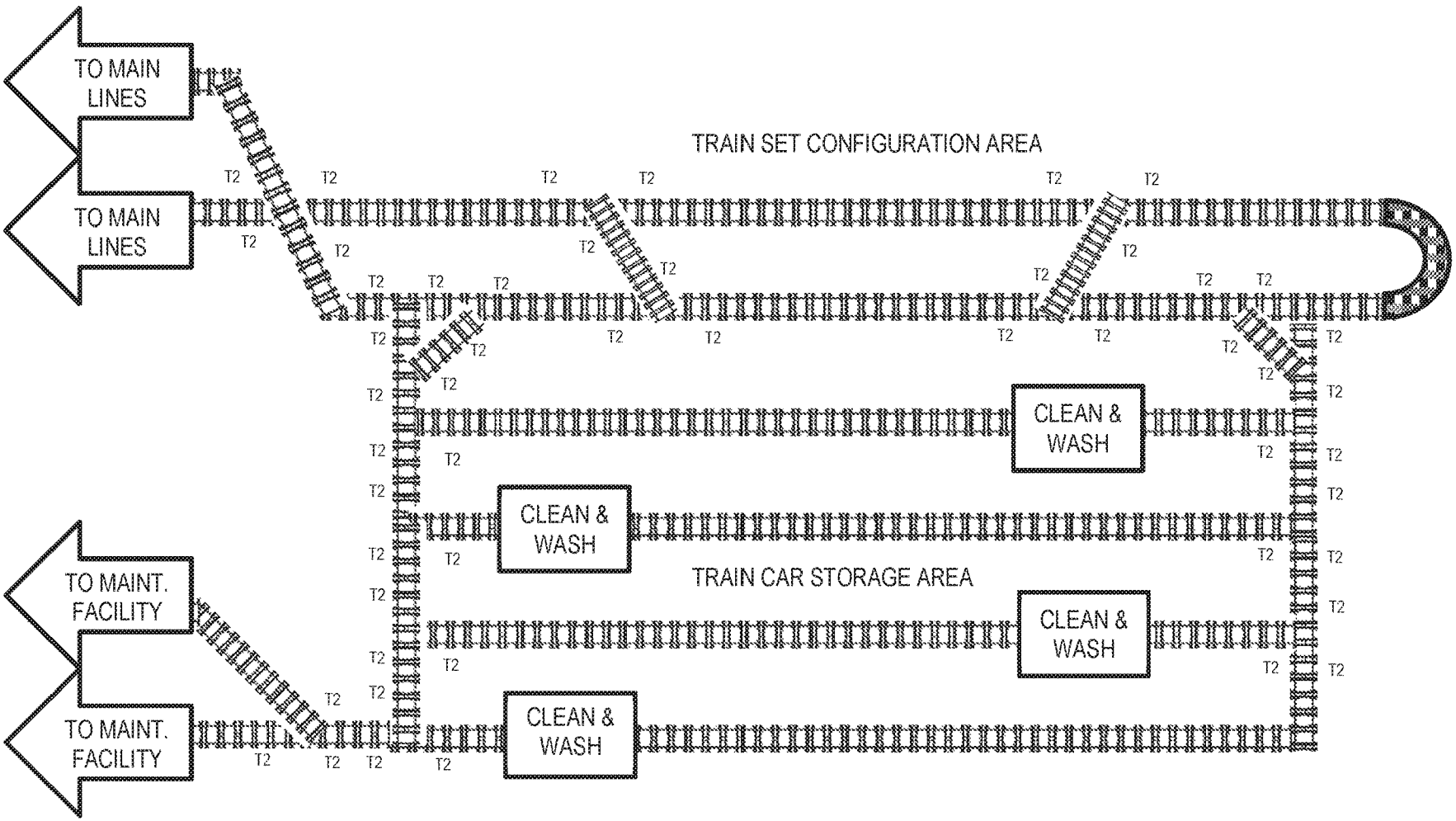
FIG. 9A shows a plan view of an exemplary train yard for storing and arranging train cars in accordance with an embodiment.

For a train set consisting of a plurality of train cars, train operators traditionally reorient train cars to prevent unequal erosion of components. Hence when configuring a train set from individual train cars, operators need to know which end of each car to couple first in assembling the train set. Through a yard track network configured with elements as depicted in FIGS. 9A and 9B, the system can automatically route train cars through the network to form a new train set, with all cars facing in the required direction.

To do so, on entry into the yard, each train car communicates with the yard controller, exchanging a Train Yard Data word that allows the yard controller to know each car's orientation and position in its current train set configuration. The Yard controller, via the type 2 tags, routes and parks the train set. If the train set is to be broken up into individual cars, the system may also route the train set to one or more brake up points within the yard. All train car locations are tracked via the type 2 tags and sent to the yard controller database.

The yard controller then allows users to configure train sets from individual train cars within the yard, and to orient the cars as required, and place them in the proper position in the new train set. All cars need to be fitted with Readers.

Figure 9B:
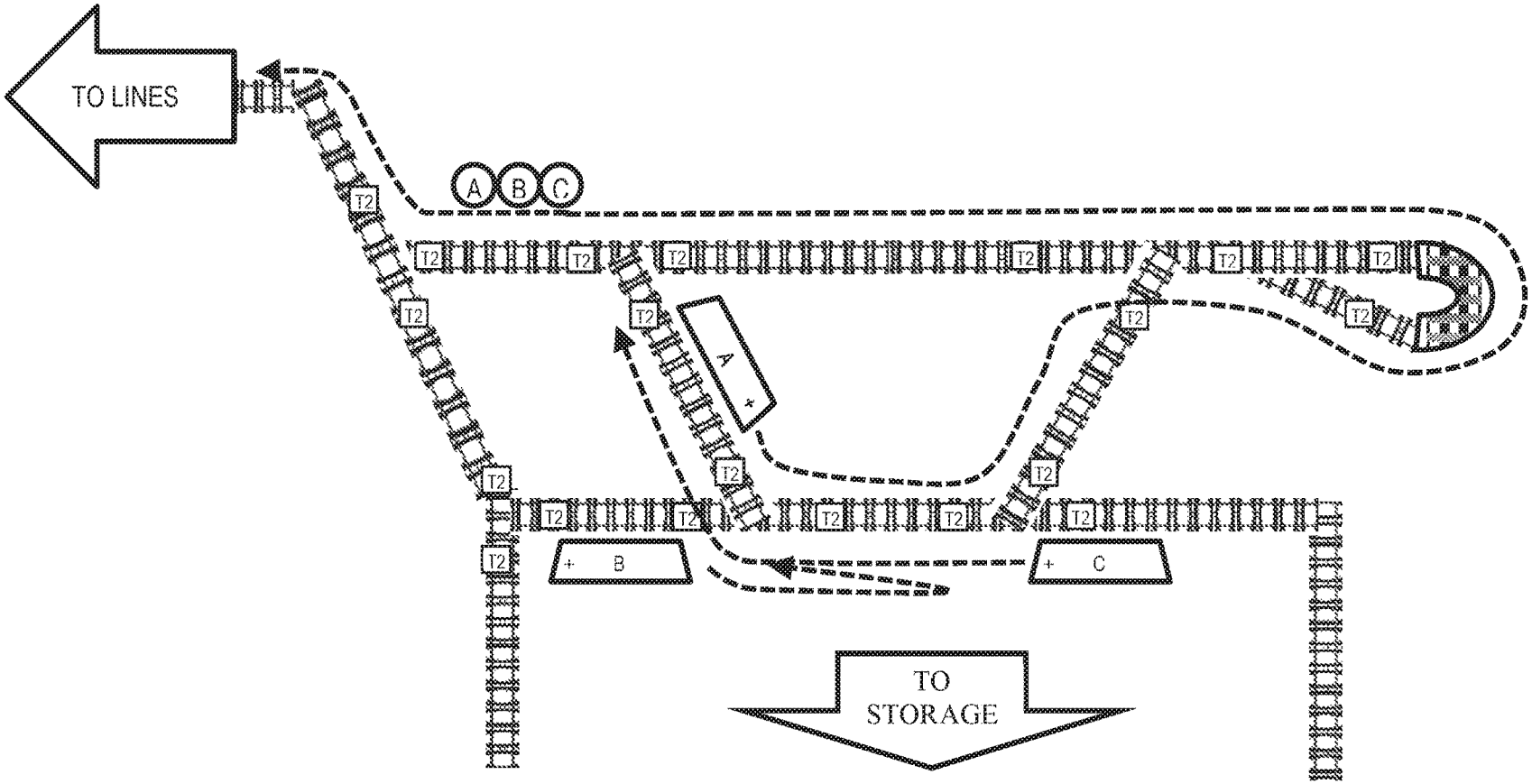
FIG. 9B shows in detail a portion of the train yard of FIG. 9A.

A suggested storage yard feature includes a turn loop or turntable and cross over switches, as shown in FIG. 9B for example, for more complete operation of the train set configuration area.

Emergency and Maintenance Tool

With a traditional train control system, Railway Operation access to operational track infrastructure is controlled via the Route Control Center (RCC) responsible for that track. Even in an emergency scenario, emergency services and maintenance crews cannot enter the track infrastructure until permission is received from the RCC. This system relies on a verbal message or written communications.

For a Railway Operation fitted with a Wireless Train Management System as described in the foregoing, an emergency and maintenance tool (EMT) allows for emergency services and maintenance crews to more easily be granted access to track infrastructure. The device will allow certified crew to place emergency speed restrictions on the rail network directly, with no RCC intervention required.

An emergency speed restriction may be imposed by using the EMT to temporarily add a virtual train to the train network. The virtual train is added by using the device to overwrite a train data word currently stored on a select RFID tag. The virtual train may have a Train ID of "911" or "511" for example, depending upon the scenario prompting the need for track access. Trains in the area of the virtual train will read the train data word and take appropriate action to slow down in or avoid the restricted area. The virtual train word may also contain a speed limitation so that trains entering the area will know what speed they may safely travel until a virtual train clear notification is issued.

The virtual train speed can be set anywhere between 0 (stop) up to the maximum line speed. Virtual train speeds cannot provide trains authorization to travel above the maximum line speed, as determined by the rail authority operating the line.

The EMT device may be portable and be able to be carried by a single person. The tool may be preprogrammed by the operating rail authority with the virtual train ID and Speeds.

The user may, upon following the correct authentication protocol, view the virtual train ID and the default speed restriction to be applied. A default speed restriction may be set that is the lowest value of the speeds available to the user.

When the work that caused the virtual train to be implemented is completed, the user, following the protocol, is able to select "clear" speed notification in order to allow normal traffic operation to resume.

Although embodiments of the invention have been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A train control system comprising:

a train set including at least one railway car;

a track switch controller;

at least one first set of two track points located along a first track switch section;

at least one second set of two track points located along a second track switch section coupled via a track section to the first track switch section;

at least one RFID tag having no preprogrammed data and which is located at each of the at least one first set of two track points configured to store dynamic and static characteristics of the train set as it passes the at least one first set of two track points, wherein the dynamic characteristics stored on the at least on RFID tag are configured to be updated at the at least one first set of two track points, according to characteristics of the train set passing by the at least one first set of two track points;

the at least one RFID tag having no preprogrammed data and which is located at each of the at least one first set of two track points and the at least one second set of two track points, the at least one RFID tag being configured to store dynamic and static characteristics of the train set as it passes the at least one second set of the at least two track switches;

a directional antenna coupled to the at least one railway car of the train set and configured to acquire a unique identifier (UID) of the at least one RFID tag; and at least one RFID tag reader located on the at least one railway car connected to a network, wherein the at least one railway car writes data to the at least one RFID tag such that the data is read by the at least one RFID tag reader of a following railway car, and wherein the data of the at least one RFID tag is overwritten with new data each time at least one railway car passes by the at least one first set of two track points and as it passes by the at least one second set of the two track points.

2. The train control system of claim 1 wherein the directional antenna exchanges information with the at least one RFID tag when the train set is moving below a speed of 30 MPH.

3. The train control system of claim 1 wherein the directional antenna provides a location reference equal to a width of the directional antenna.

4. The train control system of claim 3, further comprising:

a processor coupled to the directional antenna that is configured to:

determine a location of doors on the train set referenced to a location of the at least one RFID tag reader; and calculate a required distance to travel to align the doors to a fixed stop point.

5. The train control system of claim 4, further comprising:

a series of tags spaced at predetermined locations along the track based on a final stopping point and a brake profile of the train set to enable a stopping accuracy of approximately +/−12.5 feet, with a last tag in the series of the tags being configured to indicate the final stopping point.

6. The train control system of claim 5, wherein the series of tags includes five tags, and wherein the predetermined locations of each of the at least one RFID tag for the series of tags comprises a first tag of the at least one RFID tag being separated by five feet from a subsequent tag of the at least one RFID tag.

7. The train control system of claim 1, further comprising:

a train yard including:

a train set configuration track section;

a train storage track section; and a track coupling the train yard to at least one operational train line, wherein each switch in the track layout includes a type 2 RFID reader at each point where a track converges on the switch, wherein the train yard is configured to allow for disassembly of the train car into the least one railway car, allow for storage of the at least one railway car, and allow for reassembly of the at least one railway car in another configuration for the train car.

8. The train control system of claim 7, further comprising:

at least one turnaround loop or turntable for reversing the orientation of the at least one railway car.

9. The train control system of claim 1 further comprising:

at least one railway car cleaning and washing facility and a maintenance facility.

10. The train control system of claim 1, further comprising:

an emergency and maintenance tool (EMT) that allows emergency services and maintenance crew to enter track infrastructure and place speed restrictions without permission from the Route Control Center (RCC).

11. The train control system of claim 10, wherein the EMT temporarily adds a virtual train to a train network by overwriting a train data word currently stored on a select RFID tag with that of a virtual train having a Train ID of "911" or "511", and wherein preceding trains read the train data word and take action to avoid or slow down in the restricted area.

12. The train control system of claim 11, wherein the virtual train word contains a speed field that indicates to tangible trains in or entering the restricted area what speed they may travel, until a virtual train clear notification is sent by the EMT, wherein a range of the valid speed is between 0 and a maximum line speed as determined by the rail authority operating the line, and wherein the EMT is programmed by the operating rail authority with the virtual train ID and the range of the valid speed.

13. A method of assembling a train system from train cars having RFID tag readers located in a storage yard, the method comprising:

receiving, via a central controller system or engine, a train yard data word from each of the train cars upon entry into the storage yard;

identifying, via the central controller system or engine and from the train yard data word, a track orientation of each of the train cars and a position of each of the train cars in a current train set configuration;

reading, via the central controller system or engine, the RFID tag readers of each of the train cars;

assigning, via the central controller system or engine, a train car identifier to each of the train cars;

routing and parking, via the central controller system or engine communicating with type 2 RFID tag sets located at track points converging at a track switch, each of the train cars; and in response to a determination that the current train set configuration is to be broken up into the train cars, routing or re-routing, via the central controller system or engine, the current train set configuration to a break up point within the storage yard; and configurating, via the central controller system or engine, a new train set configuration from the train cars within the storage yard by:

orienting or re-orienting the train cars;

positioning the train cars to a proper position for the new train set configuration; and coupling the train cars together to form the new train set configuration.

14. The method of claim 13, wherein the train cars are re-oriented via a reverse loop or turntable in the storage yard.

15. A method of claim 13, further comprising:

sending a communication, by a first of the train cars of a train set being assembled to a second of the train cars of the train set being assembled via the central controller system or engine, the communication including a first car identifier, a first car location, and a first car orientation, wherein the first train car of the train set communicates to the second car of the train set via a communication system, the communication system including:

at least one first RFID tag having no preprogrammed data and located at each of at least one first set of two track points, wherein the at least one first RFID tag is configured to store characteristics of the first train car as it passes the at least one RFID tag, and wherein the characteristics stored on the at least one first RFID tag are configured to be updated with characteristics of a second train car passing by the at least one first RFID tag;

at least one second RFID tag having no preprogrammed data and located at each of at least one second set of two track points, wherein the at least one second RFID tag is configured to store characteristics of the first train car as it passes the at least one second RFID tag, and wherein the characteristics stored on the at least one second RFID tag are configured to be updated with characteristics of the second train car passing by the at least one second RFID tag;

a first directional antenna coupled to the first car and configured to acquire a unique identifier (UID) of the at least one RFID tag;

a second directional antenna coupled to the second car and configured to acquire a unique identifier (UID) of the at least one RFID tag;

at least one RFID tag reader located on the first train car and at least one RFID tag reader located on the second train car, wherein the first train car writes data to the at least one first RFID tag such that the data is read by the at least one second RFID tag reader of the second train car, wherein the data of the at least one first RFID tag is overwritten with new data each time a train car passes by the at least one first set of track points and as it passes by the at least one second set of track points, and wherein the track switch controller is configured to implement a direction of travel, speed, and orientation of the first train car and the second train car as needed to assemble the train set.

16. The method of claim 15, wherein the first train car and the second train car communicate to a yard controller via the communication system.

17. The method of claim 16, wherein the communication system comprises a backup or a fail-safe system.

18. The method of claim 17, wherein the RFID tag of the backup or the fail-safe system stores a speed, a brake status, a train car ID, a switch status, a current time, and a time of a last train car to pass the RFID tag.

19. The method of claim 18, further comprising:

updating the speed, the brake status, the train ID, the switch status, the current time, and the time of a last train car to pass the RFID tag when a train car passes the RFID tag.

* * * * *